United States Patent [19]

Isner

[11] Patent Number: 4,810,319

[45] **Date of Patent: * Mar. 7, 1989**

[54] METHOD OF MAKING A MONOFILAMENT HAVING ON THE SURFACE EMBEDDED FILAMENTONS MATERIAL

[76] Inventor: Robert E. Isner, 222 Martling Ave., Tarrytown, N.Y. 105911

[ * ] Notice: The portion of the term of this patent subsequent to Aug. 26, 2003 has been disclaimed.

[21] Appl. No.: 899,662

[22] Filed: Aug. 25, 1986

Related U.S. Application Data

[63] Continuation-in-part of Ser. No. 580,881, Feb. 16, 1984, Pat. No. 4,608,212, which is a continuation-in-part of Ser. No. 709,601, Jul. 29, 1976, abandoned.

[51] Int. Cl.[4] ..... B06B 1/02; D01D 5/253

[52] U.S. Cl. ..... 156/244.11; 156/244.17; 264/22; 264/24; 264/176.1; 264/177.13; 264/177.17; 264/167; 264/237; 264/348; 425/174.8 E

[58] Field of Search ..... 264/24, 22, 176.1, 177.13, 264/177.17, 167, 237, 348; 425/174.8 E; 156/244.11, 244.17

[56] References Cited

U.S. PATENT DOCUMENTS

| | | | |
|---|---|---|---|
| 2,108,361 | 2/1938 | Asakawa | 264/22 |
| 2,491,889 | 12/1949 | Bennett et al. | 264/22 |
| 2,636,216 | 4/1953 | Huebner | 264/22 |
| 2,886,877 | 5/1959 | Frickert et al. | 425/325 |
| 3,224,497 | 12/1965 | Blomgren, Sr. et al. | 165/2 |
| 3,551,178 | 12/1970 | Chmelar | 118/629 |
| 4,311,113 | 1/1982 | Jordan | 118/629 |

FOREIGN PATENT DOCUMENTS

| | | | |
|---|---|---|---|
| 0544904 | 8/1957 | Canada | 264/22 |
| 1348800 | 2/1962 | France | 264/24 |
| 44-04248 | 8/1969 | Japan | 425/464 |
| 46-13940 | 4/1971 | Japan | 264/24 |
| 46-37769 | 6/1971 | Japan | 264/24 |
| 51-41763 | 4/1976 | Japan | 264/22 |
| 0026511 | 2/1984 | Japan | 264/24 |

OTHER PUBLICATIONS

Business Week 8/12/72, McGraw Hill, NY "Instant Cooling by Electrostatics".

Electronic Design 20, 8-9/71, 9/30/71 McDemott "High Voltage iomic discharges provide silent, efficient cooling".

*Primary Examiner*—Jan H. Silbaugh

*Assistant Examiner*—Hubert C. Lorin

[57] ABSTRACT

A method for effecting the electrostatically enhanced and selectively directed deposition of short lengths of solid filamentous materials onto the surface of a downwardly flowing liquid monofilament in a gaseous environment concurrently with an electrostatically induced accelereated solidification of the surface modified monofilamentous material into self-supporting condition to produce embedded filamentous appendages extending therefrom.

3 Claims, 1 Drawing Sheet

FIG. 1
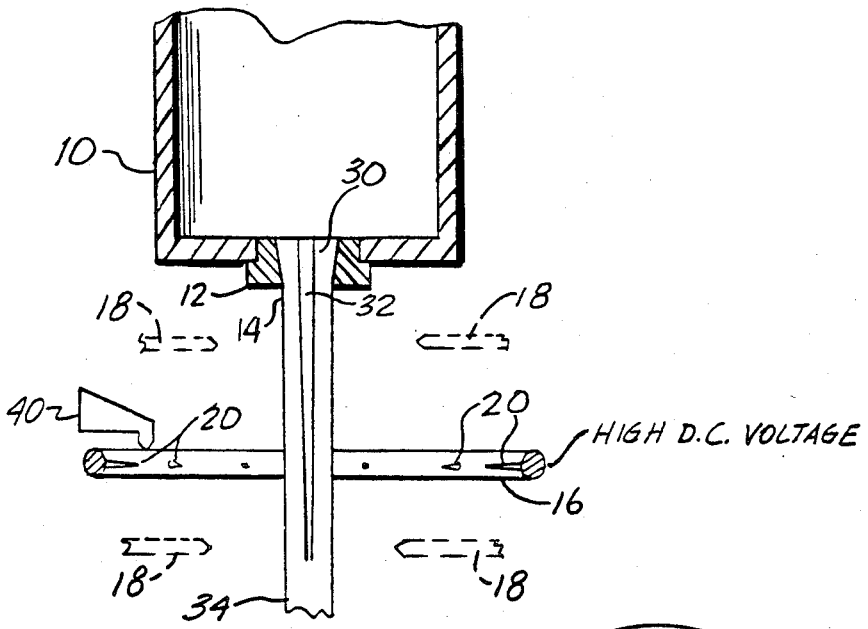
FIG. 3
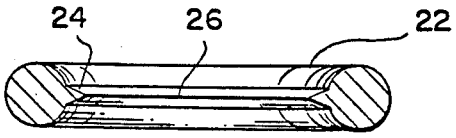
FIG. 2
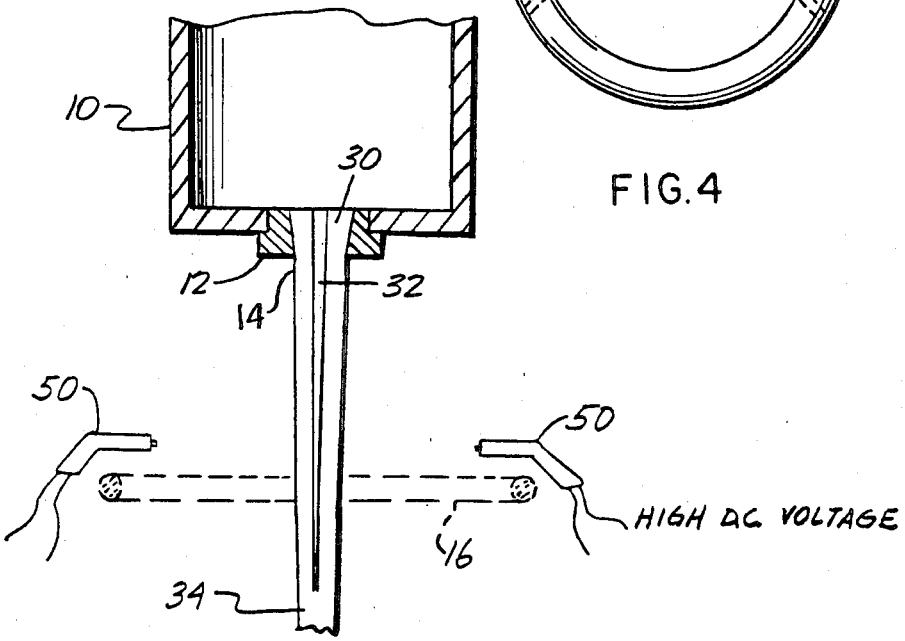
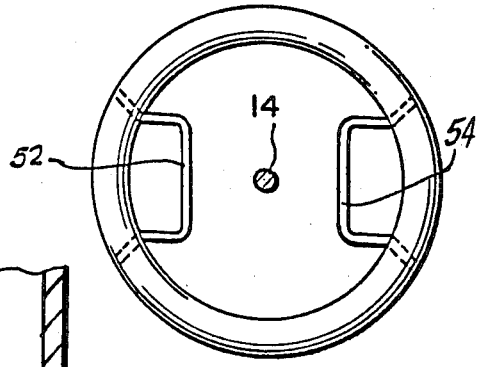
FIG. 4

METHOD OF MAKING A MONOFILAMENT HAVING ON THE SURFACE EMBEDDED FILAMENTONS MATERIAL

This application is a continutation-in-part of my application Ser. No. 580,881 filed Feb. 16, 1984 and now U.S. Pat. No. 4,608,212. Application Ser. No. 580,881 was a continuation-in-part of my earlier application, Ser. No. 709,601, filed July 29, 1976, now abandoned.

This invention relates to synthetic textile fiber fabrication and particularly to methods and apparatus for effecting electrostatically enhanced surface modification of lineal monofilaments adjacent the locus of liquid emission thereof in a gaseous environment and solidification of the surface modified monofilament into a self-supporting state.

Fibers of both natural and synthetic origin are widely employed at the present day in the textile field. Among the more familiar fibers of natural origin are vegetable fibers such as cotton, flax and the like and animal fibers such as wool and other animal hairs. The more recent years have seen an ever increasing usage of fibers of synthetic origin formed from various synthetic resinous materials and, on some occasions, from glass. While such synthetic fibers are possessed of many advantageous characteristics, the generally smooth and uniform surface characteristic of the individual fibers thereof oftentimes results in finished textile products of somewhat different character and texture i.e. "hand", than textile products formed of natural fibers, which are of a more non-uniform surface configuration.

Certain of the widely employed synthetic resinous fibers such as polyamide and polyester fibers, as well as certain nonresinous fibrous materials such as glass, are formed by the withdrawal of a monofilament from a molten reservoir thereof into a gaseous, as distinguished from a liquid, environment. Conventionally, such operation, which is generally termed "spinning", is effected by the withdrawal of the material in monofilament form through a small orifice in the liquid state, the subsequent setting of the withdrawn monofilament into effectively self-supporting condition, normally expedited by quenching air streams or the like and by the winding of the self-supporting monofilament on a reel or drum, oftentimes after subjecting the withdrawn monofilament to sufficient tension, at least for certain synthetic resinous materials, to effect an elongating deformation thereof.

Fibers so formed are in the nature of essentially straight line or lineal monofilaments of relatively uniform diameter and smooth perimetric contour. Such uniformity of diameter and smooth perimetric contour that are generally characteristic of such synthetic fiber fabrication oftentimes require subsequent treatment or deformation, such as, for example, false twisting in order to modify the filament character and to render such fibers more suitable for textile fabrication.

One of the long sought objectives of this art has been the production of synthetic fibers characterized by a non-uniform surface configuration to permit the attaining of textile products formed therefrom that additionally have some of the desirable properties that were heretofore only characteristic of textile products formed of fibers of natural origin. Over the years, many methods and techniques for effecting different types of synthetic fiber deformation have been suggested by the art. However, whether because of only marginal utility or economic impracticality of such suggestions, the selective modification of the surface contour of synthetic fibers in such manner as to permit the attaining of textile products therefrom having some of the desirable characteristics of natural fiber products, has been a long sought and as yet commercially unattained objecive of this art.

This invention may be briefly described, in its broad aspects, as an improved method and apparatus for effecting electrostatically enhanced modification of the surface of lineal monofilaments while in liquid condition adjacent the locus of liquid emission from a molten reservoir thereof in a gaseous environment with a concurrent electrostatically enhanced temperature modification thereof to accelerate solidification of the surface modified monofilaments into a self-supporting state. In its narrower aspects, the invention includes the subjection of a moving filament of liquid material to selectively constituted electrostatic field forces to selectively direct the deposition of solid short length filamentous material at a predetermined angle relative to the perimetric defining surface thereof to produce embedded outwardly extending filamentous appendages extending therefrom and to concomimitantly effect an electrostatically enhanced reduction of the temperature of the surface mofified portion of the liquid filament to effect the solidification of such modified surface to set the deposited filamentous material therein. Also included therein is the incorporation of a needle-like electrode element within the flowing filamentous material adjacent the locus of emission thereof in association with one or more adjacent electrode elements adapted to create an electrostatic field therebetween and to selectively charge the short length filamentous material to permit alignment thereof in parallel relation with the lines of force and selectively directed deposition thereof onto the surface of the liquid monofilament flowing past said needle like electrode element.

The primary object of this invention is the provision of methods and apparatus for effecting electrostatically enhanced surface modification of lineal textile monofilaments in a gaseous environment to produce discrete filamentous appendages extending therefrom.

A further object of this invention is the provision of methods and apparatus for effecting the electrostatically enhanced and selectively directed deposition of short lengths of solid filamentous materials onto the surface of a downwardly flowing liquid monofilament in a gaseous environment concurrently with an electrostatically induced accelerated solidification of the surface modified monofilamentous material into self-supporting condition to produce embedded filamentous appendages extending therefrom.

Other objectives and advantages of the invention will become apparent from the following portions of this specification and from the appended drawings which illustrate, in accord with the requirements of the patent statutes, presently preferred apparatus elements incorporating the principles of this invention.

Referring to the drawings:

FIG. 1 is a schematic representation, partly in section, of one suggested type of electrostatic field creating electrode configuration and means for introducing short length filamentous materials into the electrostatic field surrounding a monofilament being emitted in liquid condition from a molten reservoir thereof;

FIG. 2 is a schematic representation, partially in section, of an alternative construction for creating an electrostatic field at least partially surrounding a liquid monofilament and for introducing short length filamentous materials thereinto;

FIG. 3 is a schematic vertical section of an alternative electrode configuration;

FIG. 4 is a schematic plan view of a further electrode configuration.

Referring to the drawings there is provided a reservoir 10 adapted to contain a supply of molten material capable of being emitted through a small aperture in a spinnerette 12 into a gaseous environment as a liquid monofilament 14. Materials of the type contemplated include synthetic resinous materials such as polyamides and polyesters conventionally employed as textile fibers and non-resinous materials such as glass.

Mounted in the aperture 30 in the spinnerette 12 and adapted to be surrounded by the downwardly flowing liquid monofilamentous material is an elongate needle-like primary electrode element 32. As will later become apparent, the needle-like electrode element 32 may be charged at one electrical polarity but, for simplicity's sake, is preferably grounded. The primary needle-like electrode element 32 is of a length to extend over a sufficient length of emitted filament 32 while in liquid condition to permit the hereinafter described electrostatically enhanced surface modification thereof. Optimally the electrode element 32 should be of a length to permit the selective deposition of short length filamentous material onto the surface of the surrounding downwardly flowing liquid filamentous material and a concurrent electrostatically enhanced cooling of the surface of the downwardly flowing material to effect at least a hastened setting or solidification thereof about the ends of the deposited filamentous material in the vicinity of or slightly downstream of the needle end. As will become apparent, the needle element operates as one terminus of the electrostatic field and its location is generally definitive of the locus of desired surface modification. Concurrently to its serving as the terminus of an electrostatic field, such needle 32 further serves to fix or define the flow path of the emitted molten filamentous material 14 and to thereby stabilize filament positioning against filament deflecting forces as the liquid filamentous material moves to and through the locus of surface modification.

In the schematically depicted embodiment of FIG. 1, a high voltage electrode element 16 is disposed in spaced encircling relation with the emitted liquid monofilament 14 and with the lower end of the needle electrode 32. As there shown the electrode 16 may suitably be of circular configuration and may further include a plurality of inwardly directed needle-like points 20 extending therefrom and directed toward said needle electrode 32. The electrode element 16 is adapted to be connected to a remote source of high voltage, suitably a direct current source of electrical potential of a polarity opposite to that applied to the needle element 16 or, when such needle element is grounded, a source that is either positive or negative in polarity. Application of such high d.c. potential to the electrode element 16 will create an electrostatic field extending from the needle 32, through the surrounding liquid filamentous material and to the encircling electrode element 16. Disposed in adjacent overlying spaced relation with the end portions of the inwardly extending needle like points 20 is one or more feed devices 40 for introducing a stream of short length filamentous material of generally flock-like character into the electrostatic field. Such feed device can be constructed in accord with the principles disclosed in U.S. Pat. No. 3,551,178 or, alternatively, can be in the form of a vibrating tray type of flock feeding assembly as disclosed in FIGS. 2 and 3 of U.S. Pat. No. 4,311,113. Also, and if necessary, the flock feeding assembly can include an auxiliary electrode to complementally pre-charge the short length filamentous material at its locus of introduction into the electrostatic field. The introduction of the short length filamentous material adjacent the points 20 into the electrostatic field extant between the ring electrode 16 and the needle electrode 32 will result in the charging of such fibers, the aligning of the introduced short length fibers in parallel position with the lines of force and the displacement thereof toward the needle electrode 32. The leading ends of such short length fibers will embed themselves in the surface of the liquid monofilamentous material flowing downwardly around the needle electrode. At such time, their displacement toward the needle electrode 32 will be slowed, if not arrested, and the embedded fibers will be downwardly displaced in conjunction with the downwardly moving filamentous material.

Depending upon the particular operating parameters for the particular filamentous material involved, the above described electrostatic field concurrently functions to reduce the temperature of the exterior surface of the downwardly flowing liquid monofilamentous material and thus serves to thereby precondition the surface tension characteristics of the liquid monofilament and to rapidly set or solidify the locus of fiber embedment therein to firmly fix the deposited fibers in place. In some instances, however, auxiliary electrode element means, as indicated by the dotted lines 18, may be employed above and/or below the secondary high voltage electrode element 16 to create an auxiliary electrostatic field or fields to precondition the moving liquid filament and/or to co-operatively enhance the electrostatic cooling effects of the fiber depositing electrostatic field. As shown, such auxiliary electrodes 18 may precede the locus of fiber depositin so as to thermally precondition the filament for such deposition or may be disposed downstream of the locus of fiber deposition and to thereby rapidly reduce the temperature at the locus of fiber embedment.

As noted above, the short lengths of filamentous material introducable into the electrostatic depositing field are of generally flock-like character. Such fibers may be of the same or different chemical composition as the monofilament 14 being drawn or spun and can further be of a length and of a deposition density to achieve any desired type of ultimate surface modification in a drawn or undrawn condition.

In addition to the foregoing, it should be noted that the angle of approach of the short length filamentous material can be varied, within limits, by the positioning of the electrode 16 relative to the dependent end of the needle like electrode element 32. Such relative positioning will be generally determinative of the plane of the electrostatic field and concommitantly the path of approach of the short length filamentous material to the monofilament 14.

As will now be apparent to those skilled in this art, and as disclosed and claimed in my copending application Ser. No. 878,827, filed June 26, 1987, the electrostatic cooling or quenching of the liquid filament to expedite the solidification thereof can be of marked utility and advantage, in and of itself, and apart from surface modification phenomena, in textile fiber spinning operations. Such electrostatic cooling phenomena, which was broadly re-recognized in U.S. Pat. No. 3,224,497 and was described in an article in Electronic Design 20, Sept. 30, 1971, p. 22, can be employed to advantage for filament quenching where surface modification of the liquid filament is not employed, and will permit the elimination of some of the disadvantages associated with the currently employed moving air streams and quenching chambers in apparatus which a needle like electrode, such as the electrode 32, is employed. In this letter area the functions of the primary electrode element 32 in fixing the flow path of the molten filament is of particular importance since it effectively prevents displacement of the filament as a whole in the transverse direction and permits effective control of temperature reductions of the moving filament.

FIG. 2 schematically illustrates an alternative construction for creating the fiber depositing electrostatic field and for introducing the short length filamentous material therein in the same filament forming environment shown in FIG. 1. As here shown, the ring electrode 16 may be employed or may be dispensed with, as indicated by the dotted line representation thereof. Here however, one or more fiber applicator guns 50 are employed to both create the electrostatic field and to introduce the short length fibrous materials thereinto. An exemplary fiber applicator gun adapted to create and maintain the electrostatic depositing field and to effect the introduction of charged short length filamentous material therein is disclosed and described in U.S. Pat. No. 4,311,113 referred to above.

The circular or ring type high voltage electode element means 16 as illustrated in FIG. 1 presents an arcuate or rounded surface to the downwardly moving filament and additionally provides a generally uniform electrostatic field with the end of the needle 32 as the other terminus thereof. The inwardly directed points 20, if employed, operate to somewhat modify the uniformity of the electrostatic field but function to additionally charge the introduced fiber material. Alternatively such ring 16 could be circumferentially segmented to define a plurality of discrete high voltage electrode elements each presenting a rounded or arcuate surface to the moving filament.

The ends of the needle like electrode elements 20 can be of rounded configuration rather than of pointed configuration, as generally shown in FIG. 1. If desired, the ends of the electrodes 20 may be provided with spherical ends to present an arcuate or rounded surface in spaced facing relation to the moving liquid filamentous material flowing past the end of the primary electrode element 32.

FIG. 3 illustrates still another electrode configuration. In this embodiment, a circular electrode element 22 is provided with an interiorly directed conical shoulder 24 terminally in a point like corona emittable ring 26 disposed in spaced encircling relating with the liquid monofilamentous material.

FIG. 4 is schematically illustrative of a pair of diametrically opposed rounded surface electrode elements 52 and 54. In this embodiment, each electrode is adapted to be connected to a source of high alternating potential of the same frequency but preferably at 180° out of phase. Such will create a high intensity oscillating or reversing electrostatic force field which, when adjusted to proper magnitude, will effect a selective deposition of filamentous material introduced therein.

As will now be apparent to those skilled in this art, the drawings herein schematically depict an electrode system for effecting surface modification of a single filament. However the principles herein disclosed are equally applicable to pluralities of spinnerettes as are conventionally employed in the commercial spinning of both textile and glass fibers.

Having thus described my invention, I claim:

1. In the formation of fibers wherein a continuous lineal monofilament is emitted in liquid state from a molten reservoir thereof into a gaseous environment, the steps of directing said liquid monofilament into surrounding downwardly flowing relation around an elongated needle-like electrode element dependent from the locus of liquid monofilament emission from said reservoir, subjecting said emitted continuous liquid monofilament to a selectively directed unidirectional electrostatic force field having one terminus at said need-like electrode element and a second terminus at an adjacent electrode element disposed in generally transverse spaced relation with the dependent needle-like electrode, introducing short length filamentous material into said electrostatic force field adjacent to said second terminus thereof, said electrostatic force field being of a magnitude sufficient to effect coalignment of said short length filamentous material with the lines of force thereof and the directed displacement and deposition of said short length filamentous material on the perimetric surface of said downwardly flowing monofilament and concurrently subjecting said downwardly flowing monofilament to an electrostatically induced reduction of the surface temperature to accelerate the setting of said depositied filamentous material thereon.

2. The method as set forth in claim 1 wherein the step of subjecting said downwardly flowing monofilament to an electrostatically induced reduction of surface temperature is effected, at least in part, by an auxiliary electrostatic force field during its passage from the locus of deposition of said short length filamentous material thereon and the dependent end of the needle like electrode element.

3. The method as set forth in claim 1 wherein the step of subjecting said downwardly flowing monofilament to an electrostatically induced reduction of surface temperature is effected, at least in part by an auxiliary electrostatic force field during its passage from the locus of emission thereof and the locus of deposition of said short length filamentous material thereon.

* * * * *